US007104787B2

(12) United States Patent
Collier

(10) Patent No.: US 7,104,787 B2
(45) Date of Patent: Sep. 12, 2006

(54) APPARATUS FOR RADIANT TUBE EXHAUST GAS ENTRAINMENT

(75) Inventor: David Collier, Rockford, IL (US)

(73) Assignee: Eclipse, Inc., Rockford, IL (US)

( * ) Notice: Subject to any disclaimer, the term of this patent is extended or adjusted under 35 U.S.C. 154(b) by 145 days.

(21) Appl. No.: 10/839,840

(22) Filed: May 6, 2004

(65) Prior Publication Data

US 2005/0247300 A1 Nov. 10, 2005

(51) Int. Cl.
*F23D 11/44* (2006.01)
*F23C 9/00* (2006.01)

(52) U.S. Cl. ..... 431/215; 431/115; 126/91 A

(58) Field of Classification Search ..... 431/115, 431/215, 11; 126/91 A
See application file for complete search history.

(56) References Cited

U.S. PATENT DOCUMENTS 4,496,314 A 1/1985 Clarke
4,524,752 A 6/1985 Clarke
4,673,348 A * 6/1987 Riley et al. ..... 431/115
4,673,350 A 6/1987 Collier
4,705,022 A 11/1987 Collier
4,800,866 A 1/1989 Finke
4,983,118 A 1/1991 Hovis et al.
5,092,761 A 3/1992 Dinicolantonio
5,180,300 A 1/1993 Hovis et al.
5,241,949 A 9/1993 Collier
5,275,556 A 1/1994 Hirose
5,368,472 A 11/1994 Hovis et al.
6,024,083 A 2/2000 Smirnov
6,027,333 A * 2/2000 Fujii et al. ..... 431/215
6,190,159 B1 2/2001 Moore et al.
6,287,111 B1 9/2001 Gensler

FOREIGN PATENT DOCUMENTS

JP 5510811 A 8/1980
JP 59-167621 9/1984

* cited by examiner

*Primary Examiner*—Alfred Basichas
(74) *Attorney, Agent, or Firm*—Leydig, Voit & Mayer, Ltd.

(57) ABSTRACT

A radiant tube burner system comprises a novel flue gas recirculating assembly for reducing nitrous oxides emissions. In the burner system, the combustion air conduit running to the radiant tube burner intersects the exhaust conduit at a location between the radiant tube and the eventual exhaust outlet. A venturi is formed at this intersection. The venturi is configured to suction a portion of the flue gas from the exhaust conduit into the combustion air flow. The assembly includes a may be interposed along the exhaust conduit mounted directly between the radiant tube and a downstream section of the exhaust conduit.

17 Claims, 6 Drawing Sheets

10
12
14
16
18
20
22
24
26
28
30
32
34
36
38
40
42
44
46
50
51
53
Burner
Burner

APPARATUS FOR RADIANT TUBE EXHAUST GAS ENTRAINMENT

FIELD OF THE INVENTION

This invention pertains generally to radiant tube burners and more particularly to methods and apparatus for recirculating flue gas so as to reduce nitrous oxides ($NO_x$) emissions.

BACKGROUND OF THE INVENTION

Radiant tube burner systems are well know as generally disclosed in various U.S. Patents assigned to the present assignee, Eclipse Combustion, Inc., including U.S. Pat. No. 4,673,350 to Collier; U.S. Pat. No. 4,705,022 to Collier; U.S. Pat. No. 5,241,949 to Collier; and U.S. Pat. No. 6,024,083 to Smirnov. The entire disclosures of all of these patents are hereby incorporated by reference. As generally disclosed in these patents, a radiant tube burner system generally comprises a burner having a combustion air inlet, a fuel inlet, and a burner head that extends into to a radiant tube (often a U-shaped or W shaped tube). The radiant tube is mounted through a furnace wall with inlet and outlet openings on the outside of the furnace. The advantage of using a radiant tube is that the internal environment of a furnace may be kept as a clean environment substantially free of products of combustion, known as flue gas. During operation, the burner convey combustion oxidant (e.g. combustion air generated by a blower) and gaseous fuel to the burner head for combustion and into the radiant tube, where heat is radiated. The products of combustion or flue gases are then conveyed to an exhaust stack for exhausting outside the factory into the ambient environment.

As with any industrial burner, the products of combustion or flue gases as they are known contain nitrous oxides ($NO_x$) emissions, which are undesirable and regulated by regulatory agencies. As a result there is a desire (and a need in some instances where emissions are too high) to reduce nitrous oxides ($NO_x$) emissions.

A well known method for reducing nitrous oxides ($NO_x$) emissions in industrial burners is to recirculate a portion of the flue gas to reduce interaction between oxygen and gaseous fuel and thereby lower the temperature, which inherently lowers the nitrous oxides ($NO_x$) emissions. Proposals for recirculating a portion of the flue gas in radiant tube burners are disclosed in U.S. Pat. No. 6,190,159 to Moore et al. and U.S. Pat. No. 4,800,866, and the entire disclosures of these patents is hereby incorporated by reference. These proposals appear to have several drawbacks relating to complexity and cost, and might be difficult to implement and control.

BRIEF SUMMARY OF THE INVENTION

The general objective of the present invention is to provide an improved way to recirculate a portion of flue gas in radiant tube burner systems to reduce nitrous oxides ($NO_x$) emissions.

The present invention is directed toward a novel flue gas entrainment mechanism for a radiant tube burner system. The radiant tube burner system generally comprises a burner that is adapted to convey combustion air and fuel from the combustion air inlet and the fuel inlet to the burner head for combustion. A radiant tube receives the burner head. An exhaust conduit is connected to radiant tube and is adapted to convey flue gas toward an exhaust outlet. A blower may be provided to generate a pressurized source of combustion air. A combustion air conduit connects the blower to the combustion air inlet of the burner. In accordance with the present invention, the combustion air conduit intersects the exhaust conduit between the radiant tube and the exhaust outlet and a venturi is formed at the intersection between the combustion air conduit and the exhaust conduit. The venturi is arranged to suction a portion of the flue gas from the exhaust conduit into the combustion air conduit.

In accordance with one aspect of the present invention, an assembly for accomplishing the radiant tube burner system is provided. This assembly includes a tubular conduit section that can be interposed along the exhaust conduit which carries the flue gas toward the exhaust outlet. The tubular conduit section includes at least four openings including a flue gas entrance port, a flue gas exit port, an oxidant entrance port and an oxidant exit port. The flue gas entrance and exit ports are connected by a flue gas passageway for communicating flue gas through the exhaust conduit toward the exhaust outlet. The tubular conduit section further includes a throat portion integral therewith that extends transversely relative to the flue gas passageway. The throat portion connects the flue gas passageway to the oxidant exit port. The assembly also includes an oxidant inlet pipe extending into the oxidant entrance port of the tubular conduit section. The oxidant inlet pipe terminates in a nozzle that is directed toward the oxidant port. With this arrangement and when oxidant flows through the oxidant inlet pipe and flue gas flows through the flue gas passageway, a portion of the flue gas is suctioned into the oxidant exit port for recirculation for reducing nitrous oxides ($NO_x$) emissions.

The invention can be used on new burner systems or used to retrofit old existing burner system units.

Other aspects, objectives and advantages of the invention will become more apparent from the following detailed description when taken in conjunction with the accompanying drawings.

DETAILED DESCRIPTION OF THE INVENTION

Figure 1:
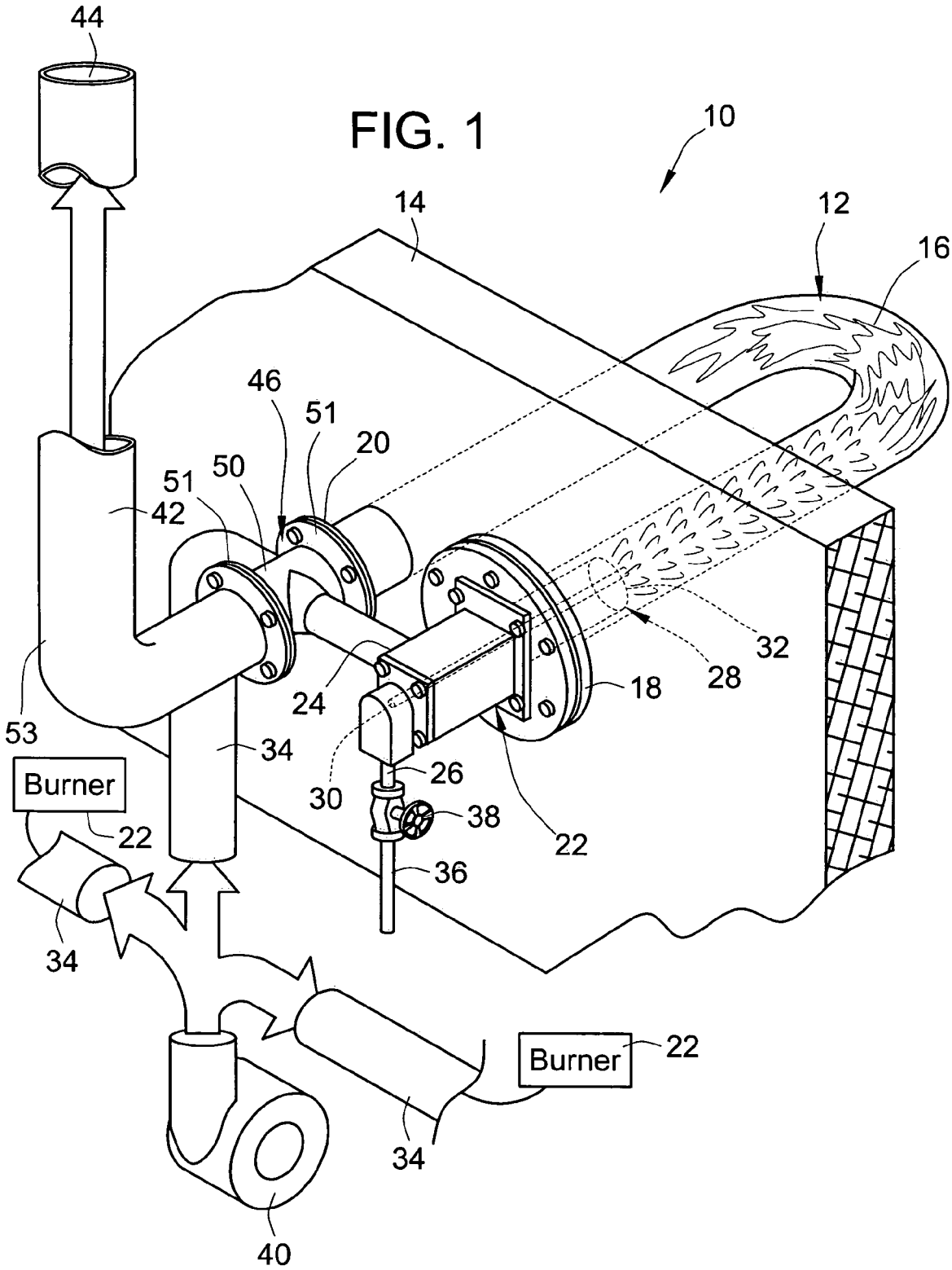
FIG. 1 is a perspective view, shown in partly schematic form, of a radiant tube burner system according to an embodiment of the present invention.
Figure 2:
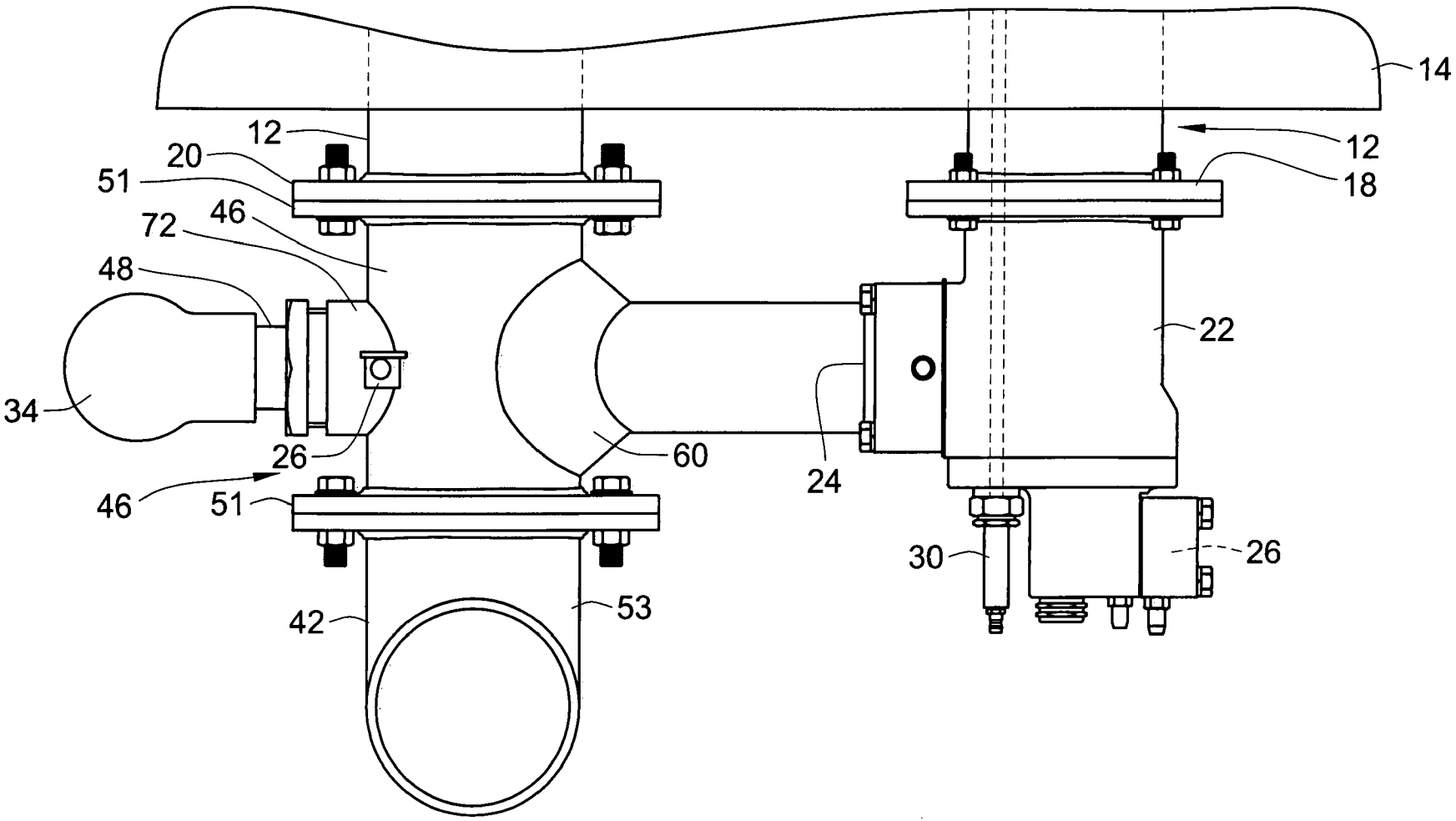
FIG. 2 is a top view of a portion the radiant tube burner system shown in FIG. 1, illustrating the novel tubular conduit section interposed on the exhaust conduit in accordance with an embodiment of the present invention.
Figure 3:
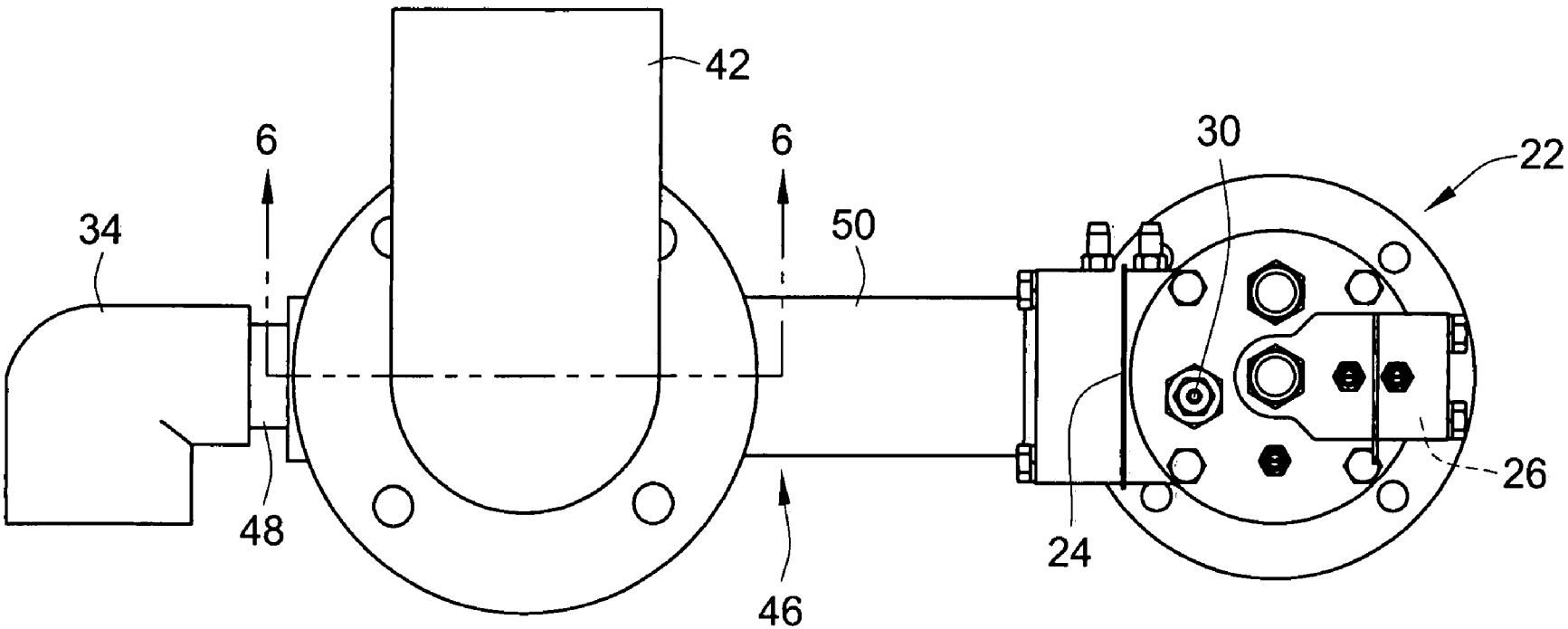
FIG. 3 is a frontal view of a portion the radiant tube burner system shown in FIGS. 1 and 2.
Figure 4:
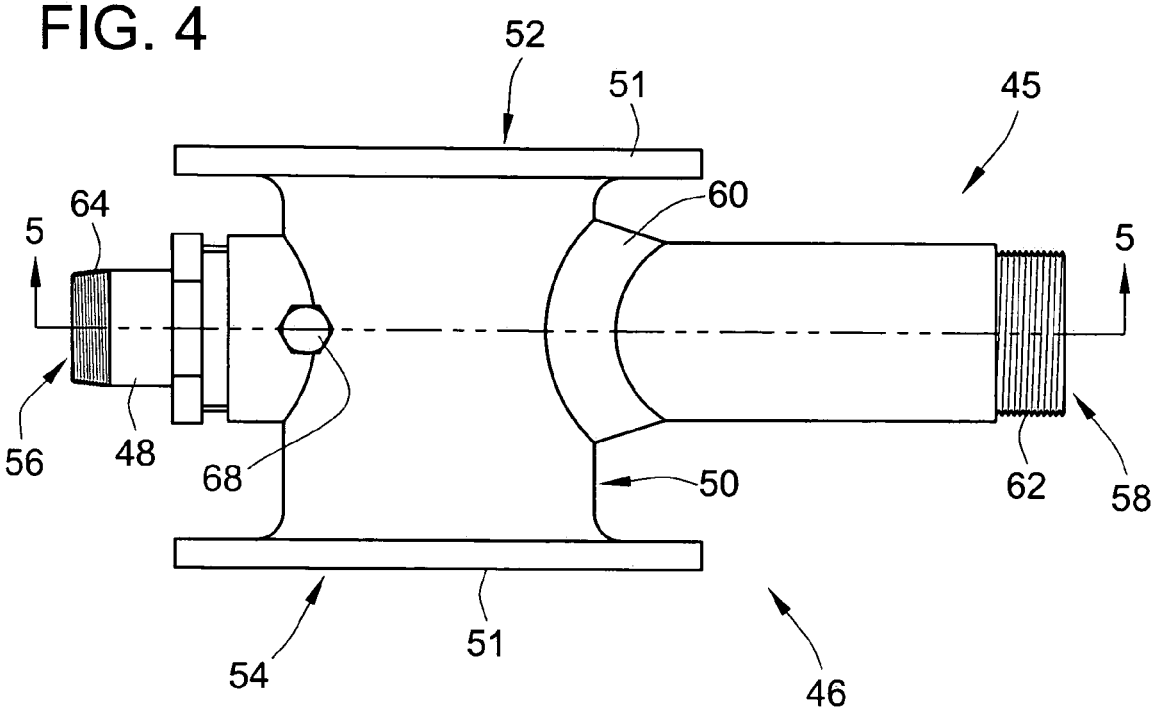
FIG. 4 is a top view of the gas entrainment assembly including the tubular conduit section and an oxidant inlet pipe used in the embodiment shown in the previous Figures.

Referring to FIG. 1, the present invention has been illustrated as embodied in a radiant tube burner system 10. The burner system 10 includes a radiant tube 12 (which may be U shaped) that is mounted to a furnace wall 14 to include U-shaped portion 16 (or other appropriately shaped portion)

on the inside of the furnace, and inlet and outlet openings on the outside of the furnace which typically terminate in and are surrounded by mounting flanges 18, 20.

As is often conventional with radiant tube burners, a burner 22 is mounted the inlet side flange 18 on the outside of the furnace. The burner 22 has a combustion air inlet 24, a gaseous fuel inlet 26, a burner head 28 and an igniter 30. The burner head 28 extends into the inlet leg of the radiant tube 12 and includes conduits for air (or another form of oxidant) and fuel, and a burner nozzle 32 (also referred to as mixing plate or combustion section) that is adapted to mix fuel and oxidant for combustion in the inlet leg of the radiant tube 12. Accordingly, the igniter 30 typically extends with the burner head (with an electrical terminal on the outside of the burner and furnace) and is positioned in close proximity to burner nozzle for igniting fuel and air. Further structural details of an appropriate burner can be had to any of the previously referenced Eclipse patents incorporated by reference in the background section above.

To communicate fuel and air to the burner 22, the system 10 includes a combustion air inlet conduit 34 in fluid communication with the combustion air inlet 24 and a fuel conduit 36 connected to the fuel inlet 26. One or more valves 38 may be interposed along the fuel conduit for setting a fuel flow rate and/or for providing a fuel shut-off function. The entrance of the air inlet conduit 34 is connected to the output of a blower 40 or other suitable combustion oxidant source (e.g. such as pressurized oxygen or oxygen enriched air). In this embodiment of the present invention, and according to one feature of the preferred embodiment of the present invention, a single blower 40 may be used to generate a pressurized combustion air flow to two or more burners 22 arranged in parallel circuit as shown schematically in FIG. 1. However, one blower 40 may also be dedicated to only one of the burners 22 if desired.

The return leg of the radiant tube 12 terminates in the outlet mounting flange 20. An exhaust conduit 42, which may comprise one or multiple sections, is mounted to the outlet mounting flange 20 and connects the radiant tube 12 to an exhaust outlet 44. The exhaust outlet 44 serves to exhaust flue gases produced by combustion generated in the radiant tube 12 to the external ambient atmosphere (e.g. typically via an exhaust stack on the outside of the factory).

In accordance with the present invention, a flue gas recirculation assembly 46 is provided that includes an oxidant inlet pipe 48 of the combustion air conduit 34 and a first conduit section 50 of the exhaust conduit. The oxidant inlet pipe 48 intersects the first conduit section 50 of the exhaust conduit 42, providing a novel configuration for recirculating a portion of the flue gas using the venturi effect. The first conduit section 50 includes an flue gas entrance port 52 and a flue gas exit port 54, connected by a flue gas passageway 55 for communicating flue gas through the exhaust conduit 42 toward the exhaust outlet 44. The entrance and exit ports may be coaxially surrounded by mounting flanges 51 that facilitate interposition of the first conduit section 50 directly on the exhaust conduit 42. As shown herein, one flange 51 is mounted directly to the return leg mounting flange 20 of the radiant tube 12, while the other flange 51 is mounted to a downstream section 53 of the exhaust conduit 42.

The conduit section 50 also includes an oxidant entrance port 56 and an oxidant exit port 58 for communicating combustion air oxidant transversely through the exhaust conduit 42. The tubular conduit section 50 also integrally includes a throat portion 60 that extends transverse relative to the flue gas passageway 55. The throat portion 60 connects the flue gas passageway 55 to the oxidant outlet port 58 and integrally provides the oxidant outlet port 58. As shown best in FIG. 5, the throat portion 60 starts at a larger diameter and flow area and converges to the oxidant exit port 58 which is at a reduced diameter and flow area. The throat portion 60 extends toward a threaded end 62 that surrounds the exit port 58. The threaded end 62 provides for mounting the of the tubular conduit section 50 to a downstream section of the combustion air conduit 34 to deliver combustion air to the combustion air inlet 24 of the burner 22.

The oxidant inlet pipe 48 is slidably inserted through the entrance port 56 of the exhaust conduit section 50 and extends toward the oxidant exit port 58. When mounted, the oxidant inlet pipe 48 defines the flow area of the oxidant entrance port 56, and provided an internal passageway 65 extending transverse relative to the exhaust gas passage. The inlet pipe 48 includes a threaded end 64 that is adapted to be connect to an upstream section of the combustion air conduit 34. The inlet pipe 48 extends linearly from the threaded end 64 toward an integrally formed nozzle 86 which is disposed internally with respect to the exhaust conduit section 50 with a trajectory directed toward the combustion air exit port 58. In the disclosed embodiment, the position of the inlet pipe 48 can be axially adjusted and can be linearly translated relative to the exhaust conduit section 50. To provide for linear adjustment, clamping means is provided by a bolt 68 that releasably clamps the inlet pipe 48 in set position. The bolt is screwed into a threaded hole 70 formed into a boss structure 72 integrally extending from the exhaust conduit section 50. The boss structure 72 defines the opening that provides for the oxidant entrance port 56 and receipt of inlet pipe 48.

In addition, an annular seal 74 is provided between the inlet pipe 48 and the exhaust conduit section 50 to prevent leakage of flue gas. The seal 74 is retained by a sleeve shaped nut 76 that is coaxial about the inlet pipe 48 and threaded into a threaded sleeve 78 extending from the boss structure 72.

Figure 5:
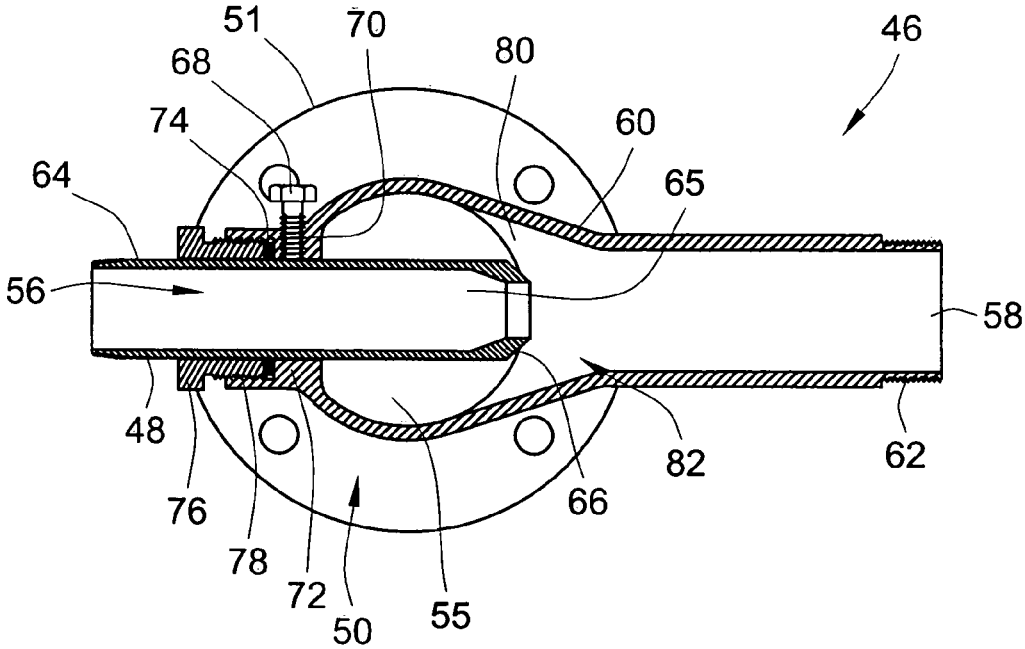
FIG. 5 is a cross section of FIG. 4 taken about line 5—5.
Figure 6:
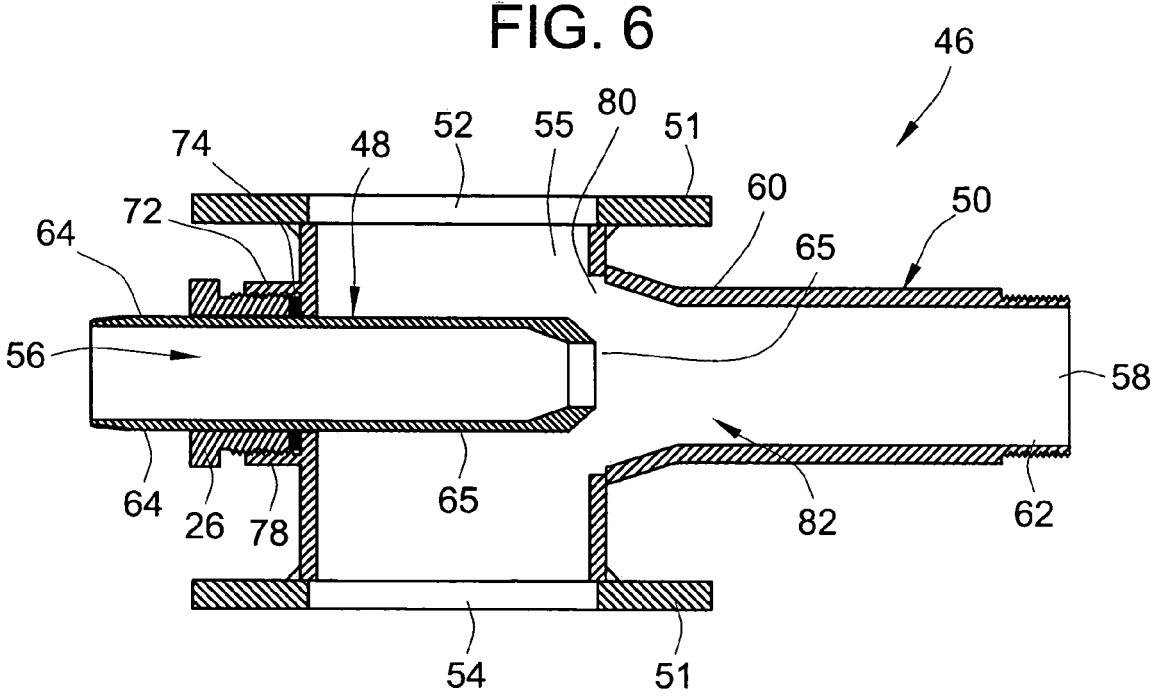
FIG. 6 is a cross section of FIG. 3 taken about lines 6—6.

As shown in FIG. 5, outer surface of the inlet pipe 48 is spaced radially inward of the inner surface of the throat portion 60 such that a flow passage 80 is defined therebetween for introducing a portion of the flue gas into the flow of the combustion air oxidant. With this arrangement, a venturi generally indicated at 82 is formed such that during operation combustion air being jetted through the nozzle 86 (with a trajectory extending with the throat portion toward the exit port 58) draws a portion of the flue gas through the throat portion 60 to the combustion air the exit port 58.

By adjusting the axial position of the inlet pipe 48 the nature and characteristic of the venturi 82 will change, thereby allowing for adjustment as to how much flue gas will be recirculated at selected operating parameters. Ordinarily, once the desired axial position of the inlet pipe 48 is set, no further adjustments may be necessary.

There are several advantages of the flue gas recirculating assembly 46. First, flue gas recirculation is effected by intersecting the combustion air and exhaust conduits 34, 42, and as a result minimal components may be needed. Additional plumbing and parallel conduit arrangements are not necessary to achieve flue gas recirculation.

Figure 7:
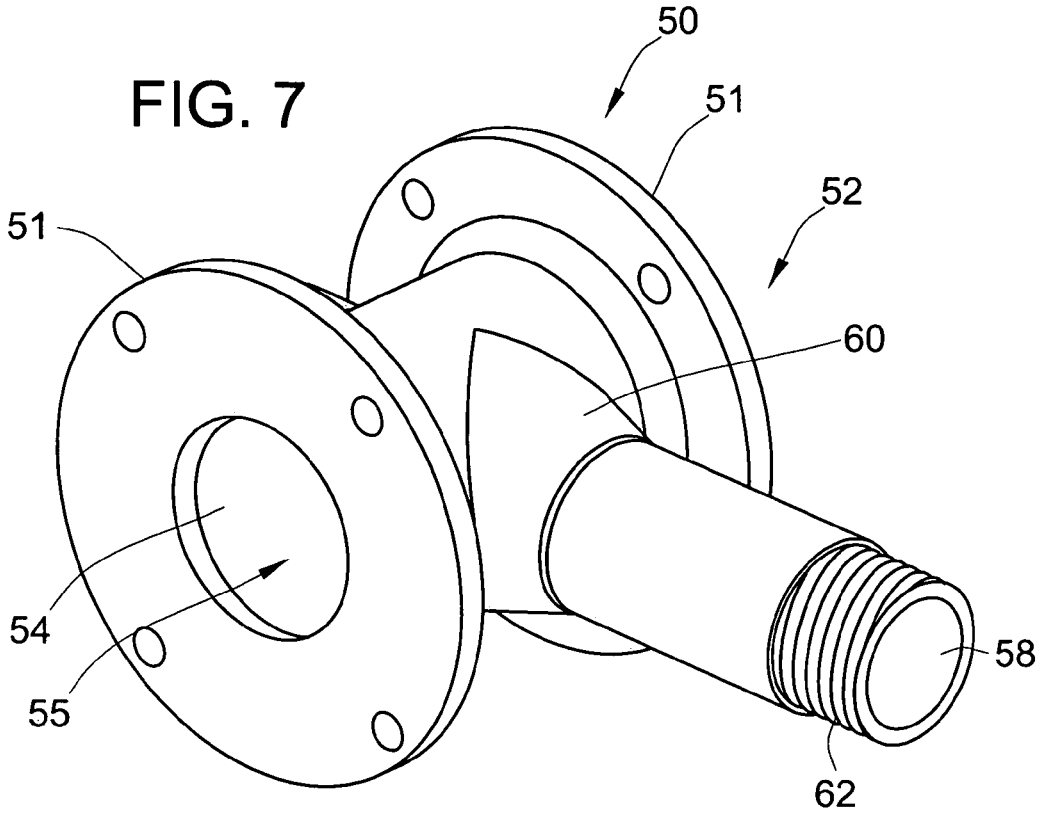
FIG. 7 is an isometric view of the tubular conduit section shown in FIG. 4.
Figure 8:
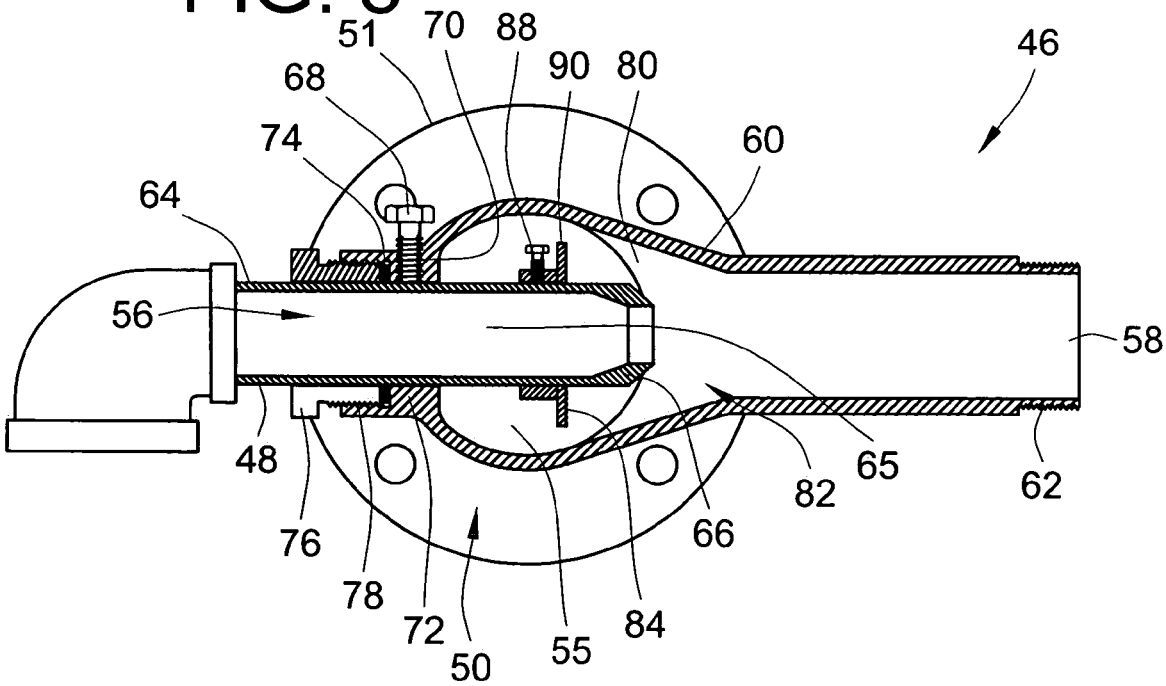
FIG. 8 is a cross section similar to FIG. 5, but showing a different embodiment that has the addition of a baffle plate.

An additional feature which may be provided is shown in the additional embodiment of FIG. 7. As shown therein, an annular restrictor plate 84 that includes a mounting sleeve portion 86 is arranged coaxial about the inlet pipe 48. The restrictor plate 84 axially slides onto the inlet pipe 48 and is secured thereto via a clamping screw 88. The clamping screw 88 is mounted into a threaded hole formed in the mounting sleeve portion 86. With the addition of the restrictor plate 84, a narrower restriction 90 is formed in the venturi arrangement 82 that serves to reduce and limit the amount of flue gas being recirculated. The position of the restrictor plate 84 relative to the throat portion 60 and the inlet pipe 48 can be selected to provide a desired environmental performance characteristic for the radiant tube burner system 10.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A radiant tube burner system for combusting fuel and combustion air, thereby forming flue gas, the radiant tube burner system comprising:

a burner having a combustion air inlet, a fuel inlet, and a burner head, the burner adapted to convey combustion air and fuel from the combustion air inlet and the fuel inlet to the burner head for combustion;

a radiant tube receiving the burner head;

an exhaust conduit connected to the radiant tube, the exhaust conduit adapted to convey flue gas toward an exhaust outlet;

a blower adapted to generate a pressurized source of combustion air;

a combustion air conduit connecting the blower to the combustion air inlet, the combustion air conduit intersecting the exhaust conduit at a location fluidically between the radiant tube and the exhaust outlet; and a venturi formed at an intersection between the combustion air conduit and the exhaust conduit, the venturi arranged to suction a portion of flue gas from the exhaust conduit into the combustion air conduit.

2. The radiant tube burner system of claim 1, wherein said exhaust conduit includes a tubular conduit section, the tubular conduit section including a flue gas entrance port and a flue gas exit port communicating flue gas through the exhaust conduit, the tubular conduit section further including an oxidant entrance port and an oxidant exit port, the flue gas entrance and exit ports connected by a flue gas passageway for communicating flue gas through the exhaust conduit, the tubular conduit section further including a throat portion integral extending transversely relative to the flue gas passageway, the throat portion connecting the flue gas passageway to the oxidant exit port; and wherein the combustion air conduit includes an oxidant inlet pipe extending through the oxidant entrance port, the oxidant inlet pipe terminating in a nozzle directed toward the oxidant exit port.

3. The radiant tube burner system of claim 2, wherein the oxidant inlet pipe is formed separately from the tubular conduit section and is movable relative to the tubular conduit section, further comprising a mounting device releasably securing the oxidant inlet pipe to the tubular conduit section, whereby a position of the nozzle can be adjusted relative to the oxidant exit port.

4. The radiant tube burner system of claim 3, wherein said mounting device comprises a screw mounted into a threaded hole in the tubular conduit section, the screw clamping the oxidant inlet pipe to the tubular conduit section.

5. The radiant tube burner system of claim 4, further comprising a threaded sleeve slidably mounted coaxial about the oxidant inlet pipe screwed into a threaded opening in the tubular conduit section, and a seal retained between the threaded sleeve and the tubular conduit section.

6. The radiant tube burner system of claim 2, further comprising a restrictor mounted on an oxidant outlet pipe arranged to restrict flow from the flue gas passageway through the throat portion.

7. The radiant tube burner system of claim 6 further comprising means for adjusting a position of the restrictor on the oxidant outlet pipe.

8. The radiant tube burner system of claim 2 wherein a recirculation passage is defined generally between the throat portion and the oxidant inlet pipe connecting the flue gas passageway to the oxidant exit port, wherein when oxidant flows through the oxidant inlet pipe and flue gas flows through the flue gas passageway, a portion of the flue gas is suctioned into the oxidant exit port through the recirculation passage.

9. An apparatus for introducing flue gas from an exhaust conduit into oxidant flowing in an oxidant conduit, the apparatus comprising:

a tubular conduit section adapted to be interposed along the exhaust conduit, the tubular conduit section including a flue gas entrance port and a flue gas exit port, an oxidant entrance port and an oxidant exit port, the flue gas entrance and exit ports connected by a flue gas passageway for communicating flue gas through the exhaust conduit, the tubular conduit section further including a throat portion integral extending transversely relative to the flue gas passageway, the throat portion connecting the flue gas passageway to the oxidant exit port; and an oxidant inlet pipe extending through the oxidant entrance port, the oxidant inlet pipe terminating in a nozzle directed toward the oxidant exit port, wherein the flue gas passageway fluidically intersects the oxidant conduit.

10. The apparatus of claim 9, wherein the oxidant inlet pipe is formed separately from the tubular conduit section and is movable relative to the tubular conduit section, further comprising a mounting device releasably securing the oxidant inlet pipe to the tubular conduit section, whereby a position of the nozzle can be adjusted relative to the oxidant exit port.

11. The apparatus of claim 10, wherein said mounting device comprises a screw mounted into a threaded hole in the tubular conduit section, the screw clamping the oxidant inlet pipe to the tubular conduit section.

12. The apparatus of claim 11, further comprising a threaded sleeve slidably mounted coaxial about the oxidant inlet pipe screwed into a threaded opening in the tubular conduit section, and a seal retained between the threaded sleeve and the tubular conduit section.

13. The apparatus of claim 9 wherein the oxidant inlet pipe is connected to a blower, the blower adapted to generate a combustion air flow, and wherein the throat portion is connected to a combustion air inlet of a radiant tube burner.

14. The apparatus of claim 9 wherein the throat portion projects generally perpendicular relative to the flue gas passageway.

15. The apparatus of claim 9, further comprising a restrictor mounted on an oxidant outlet pipe arranged to restrict flow from the flue gas passageway through the throat portion.

16. The apparatus of claim 15 further comprising means for adjusting a position of the restrictor on the oxidant outlet pipe.

17. The apparatus of claim 9 wherein a recirculation passage is defined generally between the throat portion and the oxidant inlet pipe connecting the flue gas passageway to the oxidant exit port, wherein when oxidant flows through the oxidant inlet pipe and flue gas flows through the flue gas passageway, a portion of the flue gas is suctioned into the oxidant exit port through the recirculation passage.

* * * * *